US009475336B2

(12) United States Patent
Huang

(10) Patent No.: US 9,475,336 B2
(45) Date of Patent: Oct. 25, 2016

(54) ELECTRIC PENCIL SHARPENER

(71) Applicant: Tsung Wen Huang, Chang Hua (TW)

(72) Inventor: Tsung Wen Huang, Chang Hua (TW)

( * ) Notice: Subject to any disclaimer, the term of this patent is extended or adjusted under 35 U.S.C. 154(b) by 1002 days.

(21) Appl. No.: 13/687,150

(22) Filed: Nov. 28, 2012

(65) Prior Publication Data

US 2014/0144548 A1 May 29, 2014

(51) Int. Cl.
*B43L 23/00* (2006.01)

(52) U.S. Cl.
CPC ..... *B43L 23/008* (2013.01)

(58) Field of Classification Search
CPC .... B43L 23/004; B43L 23/008; B43L 23/02; B43L 23/08; B43L 23/085
See application file for complete search history.

(56) References Cited

U.S. PATENT DOCUMENTS

2010/0326569 A1* 12/2010 Dunlap ..... B43L 23/00 144/28.71
2011/0284130 A1* 11/2011 Hsu ..... B43L 23/02 144/28.7

* cited by examiner

*Primary Examiner* — Matthew G Katcoff
(74) *Attorney, Agent, or Firm* — Bacon & Thomas, PLLC

(57) ABSTRACT

An electric pencil sharpener includes a body with an end cap connected to the front end thereof and an insertion hole is defined through the end cap. A blade assembly is located in the body and adjacent to the end cap. The blade assembly has a blade frame, a blade unit and two guide members. The blade frame has one end rotatably connected to the end cap and communicates with the insertion hole. The two guide members are connected to the front end and the rear end of the blade frame. The guide member on the rear end of the blade frame has a groove which guides pencil shavings to the collection portion. The driving unit is connected to the body to drive the blade assembly. The blade assembly is located adjacent to the insertion hole so as to reduce the length that the pencil is inserted into the sharpener.

9 Claims, 7 Drawing Sheets

ELECTRIC PENCIL SHARPENER

FIELD OF THE INVENTION

The present invention relates to an electric pencil sharpener, and more particularly, to an electric pencil sharpener which shortens the pencil length that is inserted into the sharpener.

BACKGROUND OF THE INVENTION

The conventional electric pencil sharpener is disclosed in Taiwan Patent No. I332907 and comprises a driving unit located in a body of the sharpener and the driving unit drives the blade assembly to rotate. The blade unit includes a replaceable blade unit. A cap is connected to the body and a transmission mechanism is located between the cap and the blade unit. The transmission mechanism makes the blade unit to rotate about its own axis so that the blade unit can be removed from the body.

The driving unit is connected to the link at the front end of the blade assembly, and the blade unit is located in the space located at the rear end of the link, The insertion hole is located within the link. The insertion hole is located in the link so that there is a long distance between the blade unit and the insertion hole, the distance includes the axial length of the link and the length of the driving unit so that the pencil has to be longer than the distance such that the front end of the pencil is inserted into the blade unit to be sharpened. In other words, when the pencil is shorter than the mentioned distance, it cannot be sharpened by the conventional electric pencil sharpener.

The present invention intends to provide an electric pencil sharpener that requires short distance between the insertion hole and the blade unit so that the shorter pencils can be sharpened.

SUMMARY OF THE INVENTION

The present invention relates to an electric pencil sharpener and comprises a body having a removable end cap connected to the front end thereof and the end cap has an insertion hole defined through the center thereof. A collection portion is connected to the bottom of the body. A blade assembly is located in the body and adjacent to the end cap. The blade assembly has a blade frame, a blade unit and two guide members. The blade frame has one end thereof rotatably connected to the end cap and communicates with the insertion hole. The blade unit is located adjacent to the blade frame. The two guide members are connected to the front end and the rear end of the blade frame, The guide member on the rear end of the blade frame has a groove to guide pencil shavings to the collection portion. A driving unit is connected to the rear end of the body and has a motor, a driving shaft and a gear board. The motor is engaged with the driving shaft. A first toothed portion and a second toothed portion are respectively connected to two ends of the driving shaft. The first toothed portion is driven by the motor. The gear board has a planet gear unit and a driving tube extends from the center of the gear board. The second toothed portion is engaged with the planet gear unit and the driving tube drives the blade assembly. A separation board is located between the driving unit and the blade assembly. The separation board has a curved part extending therefrom which is mounted to the guide members such that the blade assembly is precisely assembled with the driving unit.

The blade assembly and the insertion hole are located at the front end of the body, and the blade assembly directly communicates with the insertion hole so that the length that the pencil is inserted into the body is less than that of the conventional sharpeners.

The blade assembly has two guide members which are cooperated with the curved part to allow the blade assembly to be quickly and precisely assembled to the driving unit.

One of the guide members has a groove which guides the pencil shavings to move along the curved surface of the groove to be collected into the connection portion, so that the pencil shavings are not stocked at the guide toothed portion.

The blade assembly is able to be replaced easily from the front end of the body by removing the end cap from the body without any tool.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
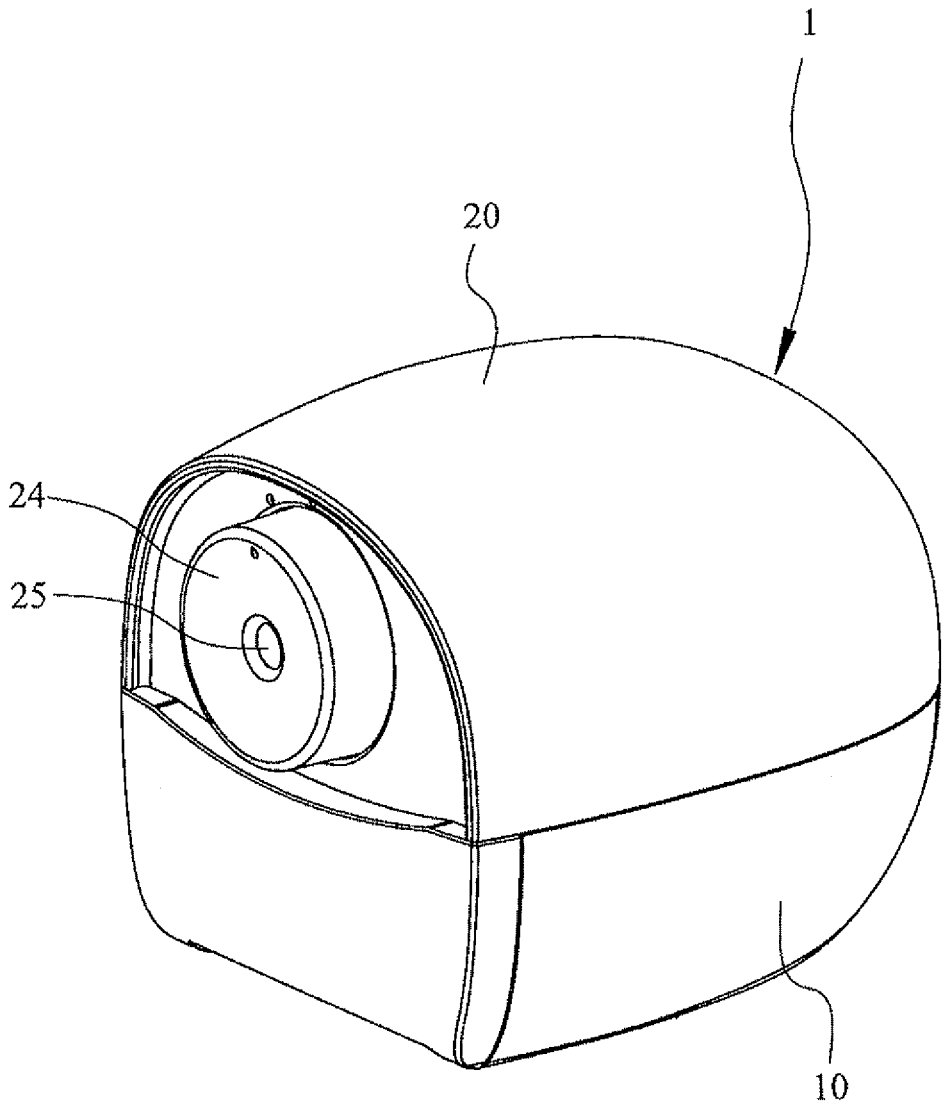
FIG. 1 is a perspective view to show the electric pencil sharpener of the present invention.

Referring to FIGS. 1 to 4, the electric pencil sharpener of the present invention comprises a body 1 composed of a bottom part 10 and a top part 20 which is mounted to the bottom part 10. A removable end cap 24 is connected to the front end of the body 1 and an insertion hole 25 is defined through the center of the end cap 24 so that the pencil 70 to be sharpened is inserted into the insertion hole 25. The bottom part 10 has a collection portion 12 at the front end thereof, and a space 11 defined in the rear end thereof.

A blade assembly 30 is located in the body 1 and adjacent to the end cap 24. The top part 20 has a bottom opening and a mounting hole 22 is defined through the front end face 21 of the top part 20. A notch 23 is defined in the inner periphery of the mounting hole 22. The end cap 24 has a protrusion 241 which is able pass through the notch 23 and the end cap 24 is rotated to restrict the protrusion 241 on the inner periphery of the mounting hole 22 to position the end cap 24 to the top part 20.

Figure 4:
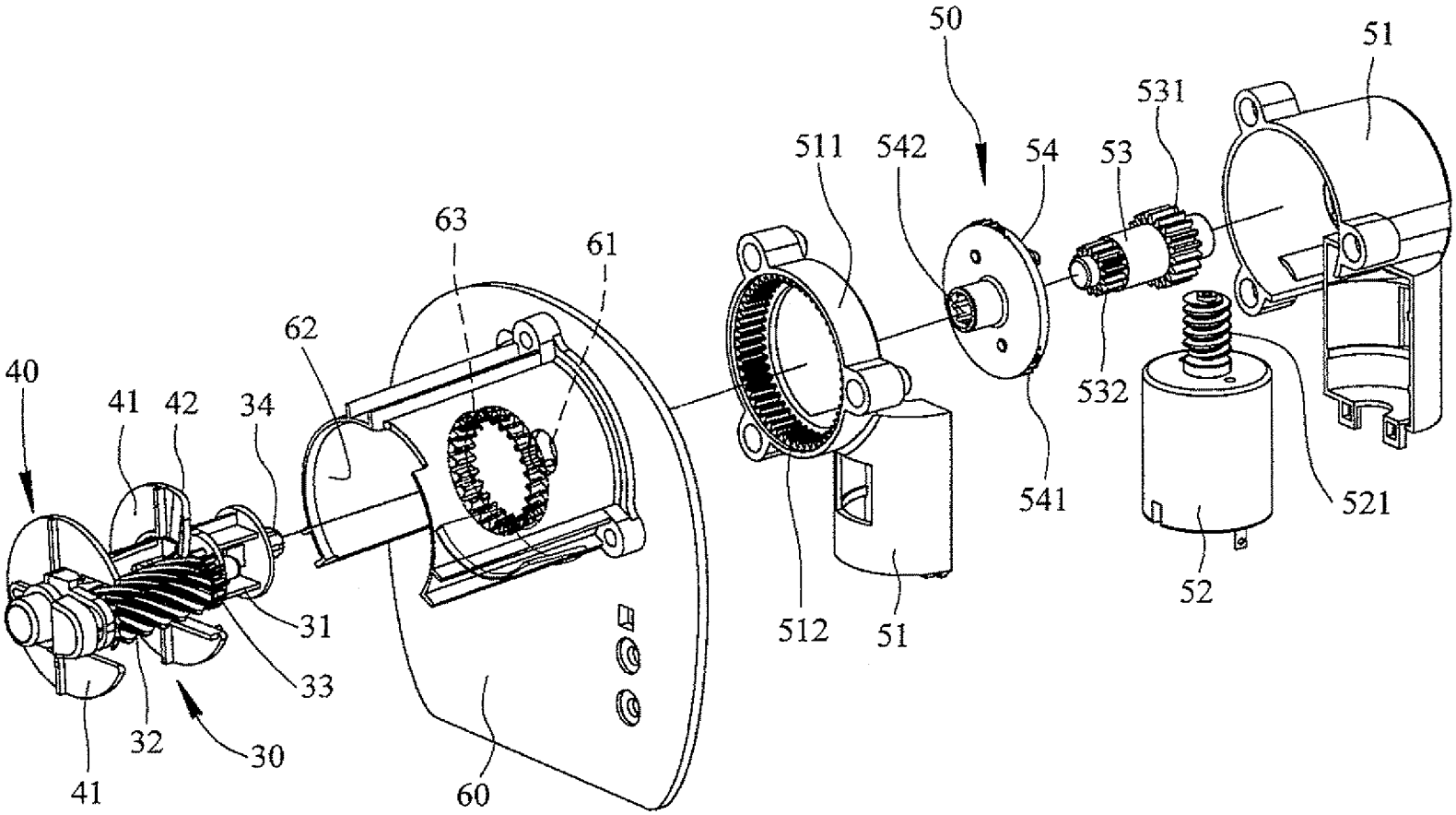
FIG. 4 is an exploded view to show the driving unit of the electric pencil sharpener of the present invention.
Figure 5:
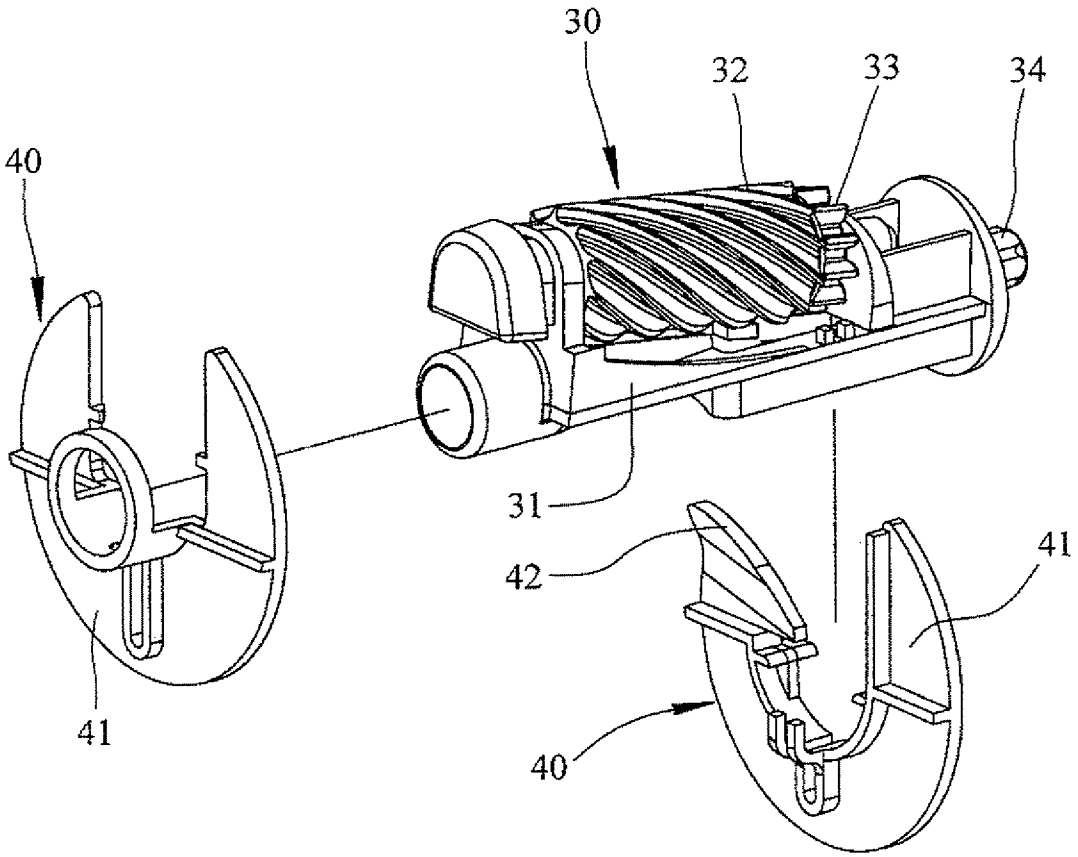
FIG. 5 is an exploded view to show the blade assembly of the electric pencil sharpener of the present invention.
Figure 6:
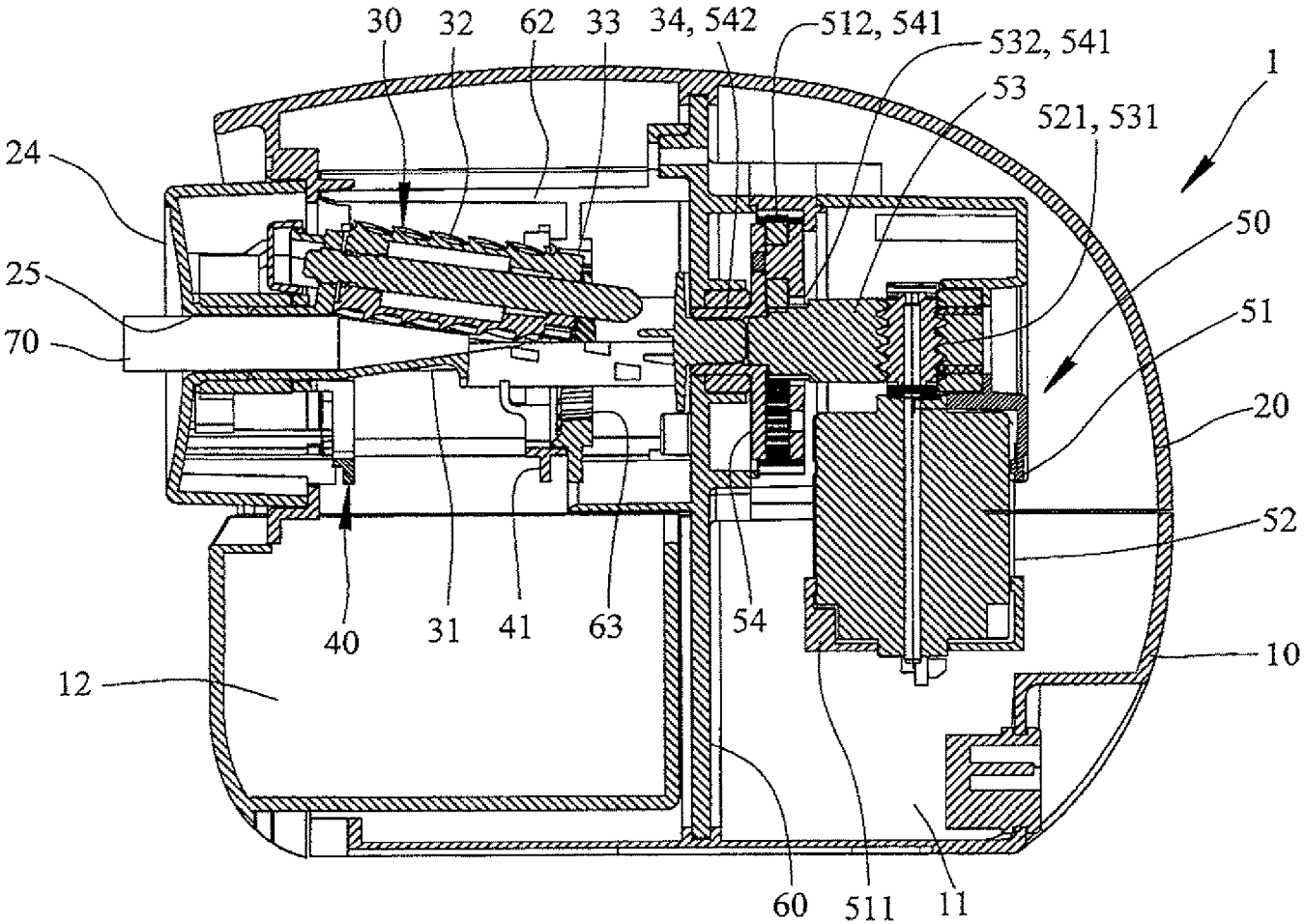
FIG. 6 is a cross sectional view to show the electric pencil sharpener of the present invention.

As shown in FIGS. 4 to 6, the blade assembly 30 comprises a blade frame 31, a blade unit 32 and two guide members 40. The blade frame 31 is a tubular member and has one end thereof rotatably connected to the end cap 24 and communicates with the insertion hole 25. The blade unit 32 is located adjacent to the blade frame 31. A guide gear 33 is connected to the rear end of the blade unit 32. The blade frame 31 of the blade assembly 30 has a passive gear 34 connected to the rear end thereof, the passive gear 34 is engaged with the driving unit 50.

The two guide members 40 are connected to the front end and the rear end of the blade frame 31. The guide members 40 each are a disk 41 with an opening, the opening of each of the disks 41 is mounted to the blade frame 31. The blade unit 32 is exposed from the openings. The guide member 40 on the rear end of the blade frame 31 has a groove 42 extending therefrom which is located adjacent to the opening of the guide member 40 and able to guide pencil 70 shavings to the collection portion 12.

A driving unit 50 is connected to the rear end of the body 1 and has a housing 51, a motor 52, a driving shaft 53 and a gear board 54. A front frame 511 is connected to the top of the housing 51 and has an inner toothed ring 512. The motor 52 has an active gear 521. A first toothed portion 531 and a second toothed portion 532 are respectively connected to two ends of the driving shaft 53. The active gear 521 is engaged with the first toothed portion 531 of the driving shaft 53 so that the first toothed portion 531 is driven by the motor 52. The gear board 54 has a planet gear unit 541 connected thereto and a driving tube 542 extends from the center of the gear board 54. The second toothed portion 532 is engaged with the planet gear unit 541 which is engaged with the inner toothed ring 512. The driving tube 542 drives the blade assembly 30.

A separation board 60 is located between the driving unit 50 and the blade assembly 30, and separates the space 11 and the collection portion 12. The separation board 60 has a curved part 62 extending therefrom which is mounted to the guide members 40 such that the blade assembly 30 is precisely assembled with the driving unit 50. The separation board 60 has a rear hole 61 through which the driving tube 542 extends and provides a support to the engagement of the driving tube 542 and the passive gear 34. The curved part 62 of the separation board 60 communicates with the collection portion 12, A guide gear 33 is connected to a rear end of the blade unit 32. A guide toothed portion 63 is connected to the separation board 60 and located around the rear hole 61 in the separation board 60. The guide gear 33 is rotatably engaged with the guide toothed portion 63, so that the blade unit 32 is rotated to sharpen the pencil 70. The blade unit 30 and the hide members 40 are rotatable within the curved part 62.

The blade assembly 30 and the insertion hole 25 are located at the front end of the body 1, and the blade assembly 30 directly communicates with the insertion hole 25 so that the length that the pencil 70 is inserted into the body 1 is less than that of the conventional sharpeners. The driving unit 50 is located at the rear end of the body 1 and away from the insertion hole 25, so that the distance between the insertion hole 25 and the blade frame 31 is shortened and this means the pencil 70 is can be used even it is short.

Figure 2:
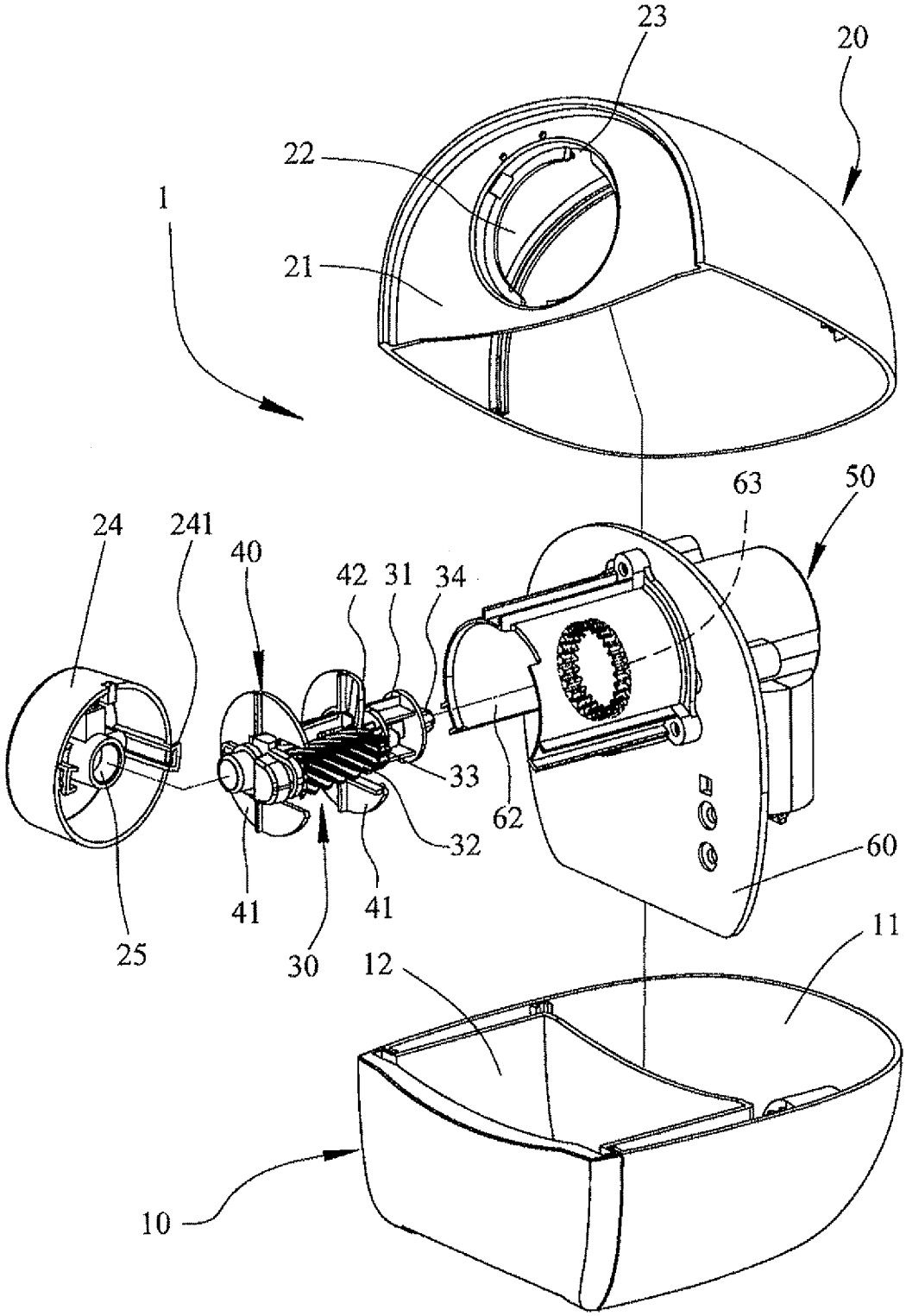
FIG. 2 is an exploded view to show the electric pencil sharpener of the present invention.

As shown in FIGS. 2, 5, 6, the blade assembly 30 has the two guide members 40, and there is a gap between the outer periphery of each guide member 40 and the inner periphery of the curved part 62 of the separation board 60, so that the blade assembly 30 can be quickly and precisely assembled to the gear board 54 of the driving unit 50.

The guide member 40 at the rear end of the blade frame 31 has a groove 42 which guides the pencil 70 shavings to move along the curved surface of the groove 42 to be collected into the connection portion 12, so that the pencil 70 shavings are not stocked at the guide toothed portion 63.

Figure 3:
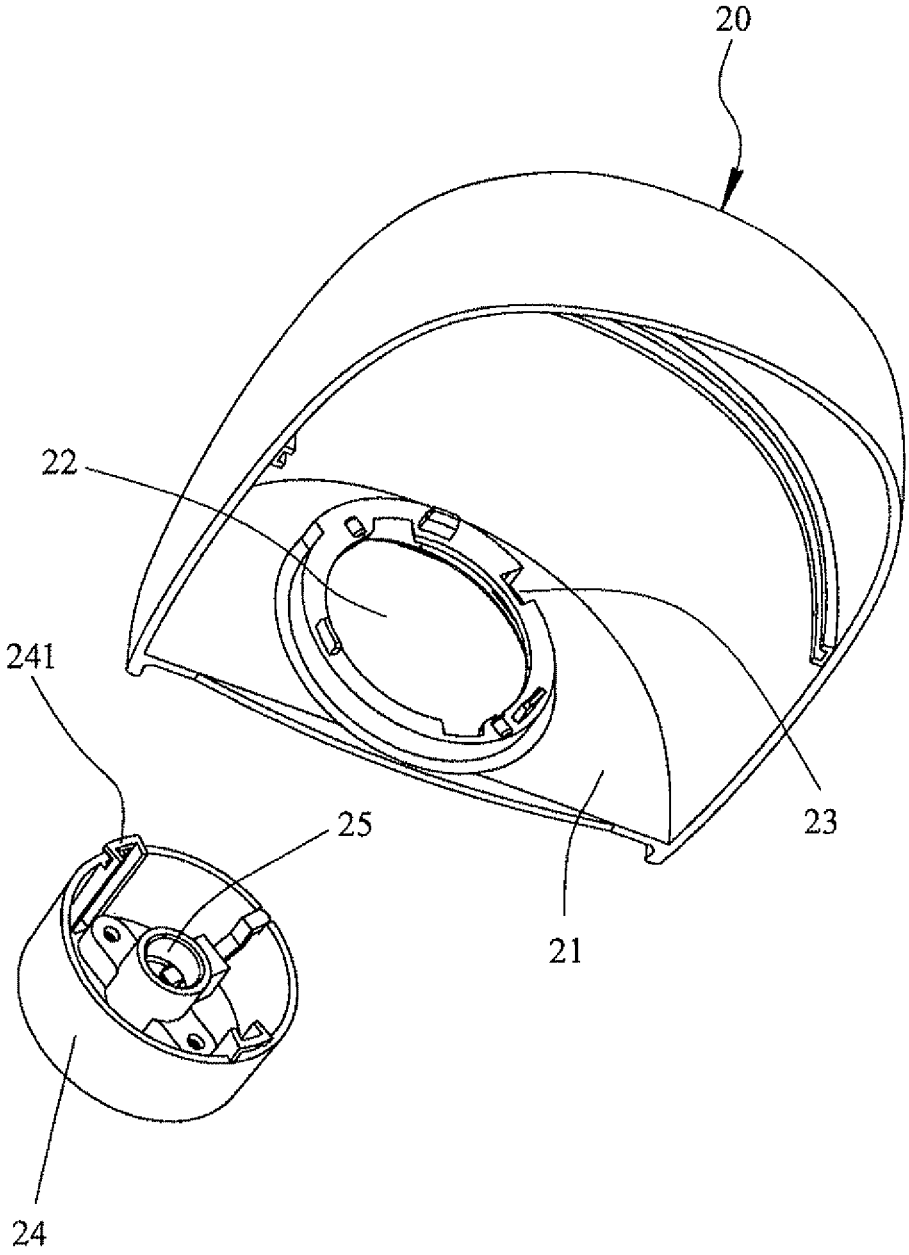
FIG. 3 is an exploded view to show the end cap and the body of the electric pencil sharpener of the present invention.
Figure 7:
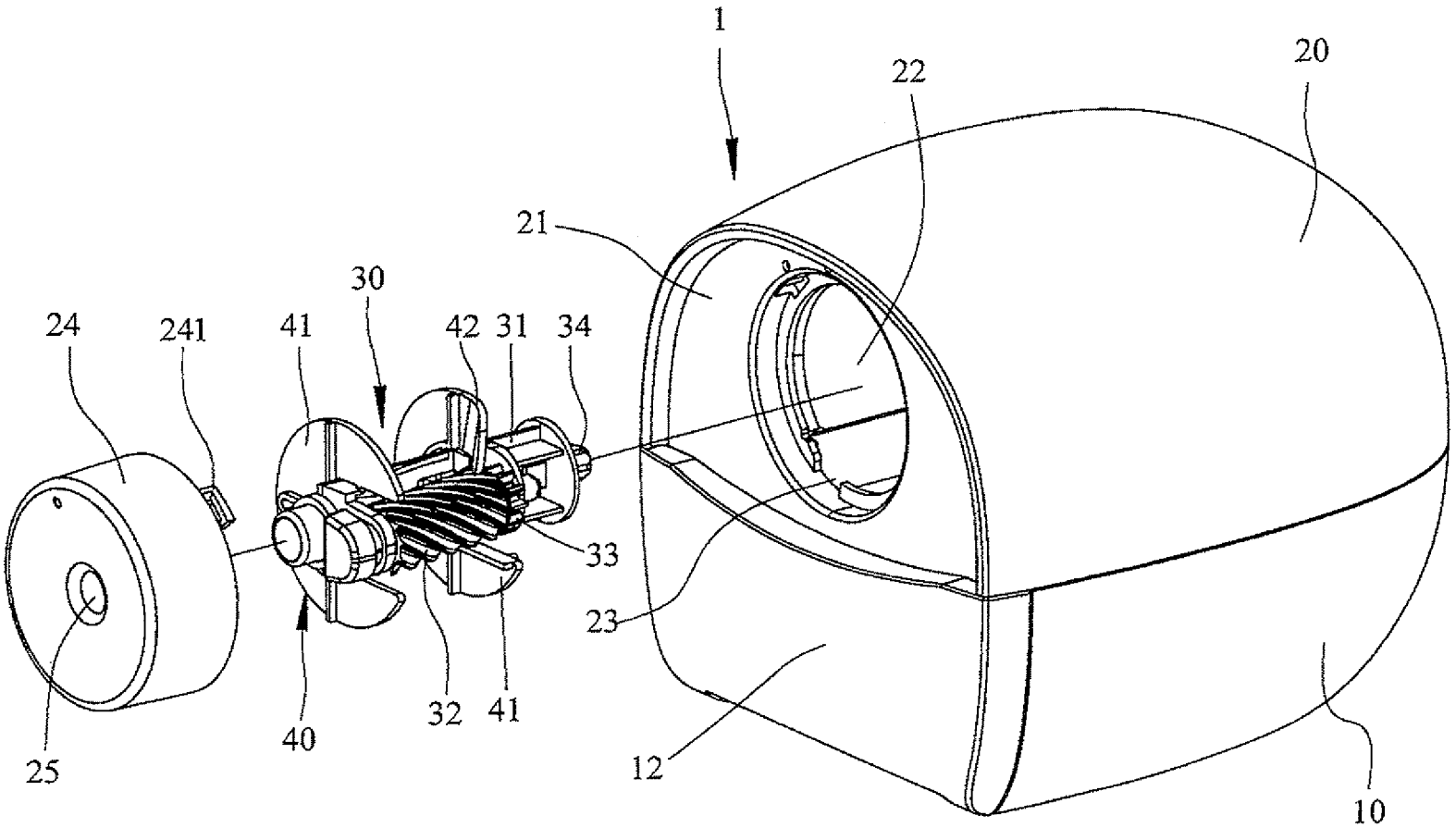
FIG. 7 is an exploded view to show the replacement of the blade assembly from the body of the electric pencil sharpener of the present invention.

As shown in FIGS. 3, 4, 7, the blade assembly 30 is replaced easily from the front end of the body 1 by rotating the end cap 24 to let the protrusion 241 move to the notch 23, and the end cap 24 can be separated from the top part 20 without any tool. The passive gear 34 can be removed from the driving tube 542 so that the blade assembly 30 and the guide members 40 can be easily replaced.

While we have shown and described the embodiment in accordance with the present invention, it should be clear to those skilled in the art that further embodiments may be made without departing from the scope of the present invention.

What is claimed is:

1. An electric pencil sharpener comprising:

a body having a removable end cap connected to a front end thereof, the end cap having an insertion hole defined through a center thereof, a collection portion connected to a bottom of the body;

a blade assembly located in the body and adjacent to the end cap, the blade assembly having a blade frame, a blade unit and two guide members, the blade frame having one end thereof rotatably inserted into the end cap and communicating with the insertion hole, the blade unit located adjacent to the blade frame, the two guide members connected to a front end and a rear end of the blade frame, the guide member on the rear end of the blade frame having a groove extending therefrom which is adapted to guide pencil shavings to the collection portion;

a driving unit connected to a rear end of the body and having a motor, a driving shaft and a gear board, the motor is engaged with the driving shaft, a first toothed portion and a second toothed portion respectively connected to two ends of the driving shaft, the first toothed portion being driven by the motor, the gear board having a planet gear unit, a driving tube extending from a center of the gear board, the second toothed portion engaged with the planet gear unit, the driving tube driving the blade assembly, and a separation board located between the driving unit and the blade assembly, the separation board having a curved part extending therefrom which is mounted around the guide members and spaced apart from the guide members such that the blade assembly is precisely assembled with the driving unit.

2. The sharpener as claimed in claim 1, wherein the body has a bottom part and a top part, the bottom part has the collection portion and a space defined therein, the separation board is located between the collection portion and the space, the top part has a bottom opening in which the blade assembly and the gear board are located.

3. The sharpener as claimed in claim 1, wherein the body has a bottom part and a top part, the top part has a bottom opening and a mounting hole is defined through a front end face of the top part, a notch is defined in an inner periphery of the mounting hole, the end cap has a protrusion which passes through the notch and the end cap is rotated to restrict the protrusion on the inner periphery of the mounting hole so as to position the end cap to the top part.

4. The sharpener as claimed in claim 1, wherein the blade frame of the blade assembly has a passive gear connected to the rear end thereof, the passive gear is engaged with the driving unit, a guide gear is connected to a rear end of the blade unit.

5. The sharpener as claimed in claim 1, wherein the guide members each are a disk with an opening, the opening of each of the disks is mounted to the blade frame, the groove of the guide member on the rear end of the blade frame is located adjacent to the opening of the guide member.

6. The sharpener as claimed in claim 1, wherein the driving unit has a housing, and a front frame connected to a top of the housing, the front frame has an inner toothed ring with which the planet gear unit is engaged, the motor has an active gear which is engaged with the first toothed portion of the driving shaft.

7. The sharpener as claimed in claim 1, wherein the separation board has a rear hole through which the driving tube extends.

8. The sharpener as claimed in claim 1, wherein the curved part of the separation board communicates with the collection portion, a guide gear is connected to a rear end of the blade unit, a guide toothed portion is connected to the separation board and located around a rear hole in the separation board, the guide gear is rotatably engaged with the guide toothed portion, the blade unit and the guide members are rotatable within the curved part.

9. The sharpener as claimed in claim 8, wherein the guide member on the rear end of the blade frame is disposed between the blade unit and the guide gear.

* * * * *